US012031440B2

(12) United States Patent
Lee et al.

(10) Patent No.: US 12,031,440 B2
(45) Date of Patent: Jul. 9, 2024

(54) ACCUMULATOR FIXING DEVICE FOR COMPRESSOR AND COMPRESSOR HAVING THE SAME

(71) Applicant: LG Electronics Inc., Seoul (KR)

(72) Inventors: Kwangkyou Lee, Seoul (KR); Jinhee Lee, Seoul (KR); Jinho Bae, Seoul (KR); Jaeyeol Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/152,389

(22) Filed: Jan. 10, 2023

(65) Prior Publication Data

US 2023/0235670 A1 Jul. 27, 2023

(30) Foreign Application Priority Data

Jan. 25, 2022 (KR) ..... 10-2022-0010953

(51) Int. Cl.

| | |
|---|---|
| ***F01C 21/00*** | (2006.01) |
| ***F04C 18/356*** | (2006.01) |
| ***F04C 29/00*** | (2006.01) |
| ***F04C 29/06*** | (2006.01) |
| ***F25B 43/00*** | (2006.01) |

(52) U.S. Cl.

CPC ..... *F01C 21/007* (2013.01); *F04C 18/356* (2013.01); *F04C 29/0092* (2013.01); *F04C 29/06* (2013.01); *F25B 43/006* (2013.01); *F04C 2230/231* (2013.01); *F04C 2240/804* (2013.01); *F04C 2270/12* (2013.01)

(58) Field of Classification Search

CPC .. F01C 21/007; F04C 18/356; F04C 29/0092; F04C 29/06; F04C 2230/231; F04C 2240/804; F25B 43/006

See application file for complete search history.

(56) References Cited

U.S. PATENT DOCUMENTS 4,888,962 A * 12/1989 Harper ..... F16B 2/065 62/297

FOREIGN PATENT DOCUMENTS

| | | |
|---|---|---|
| CN | 110220338 | 9/2019 |
| EP | 2472116 | 7/2012 |
| JP | S61046869 | 3/1986 |
| JP | 2010048241 | 3/2010 |
| JP | 2011080377 | 4/2011 |
| JP | 2016180397 | 10/2016 |
| JP | 2021032135 | 3/2021 |

(Continued)

OTHER PUBLICATIONS

Korean Patent Publication with Machine Translation, KR 2000-0056335 A; Inventor: Kim et al.; Title: A Supporting Structure of Compressor and Accumulator; Published Sep. 15, 2000. (Year: 2000).*

(Continued)

*Primary Examiner* — Mary Davis

(74) *Attorney, Agent, or Firm* — Fish & Richardson P.C.

(57) ABSTRACT

An accumulator fixing device for a compressor includes a bracket body, a first arm portion extending from the bracket body and coupled to an accumulator, and a second arm portion extending from the bracket body and coupled to a housing of a compressor. The bracket body has a cavity formed concavely on one surface facing the compressor to reduce vibration generated and transmitted from the compressor.

21 Claims, 16 Drawing Sheets

(56) References Cited

FOREIGN PATENT DOCUMENTS

| | | |
|---|---|---|
| JP | 2021120554 | 8/2021 |
| KR | 19990036037 | 9/1999 |
| KR | 20000027117 | 5/2000 |
| KR | 20050097334 | 10/2005 |

OTHER PUBLICATIONS

Korean Patent Publication with Machine Translation, KR 2018-0090676 A; Inventor: Lee et al.; Title: Supporting Apparatus; Published Aug. 13, 2018. (Year: 2018).*
Chinese Patent Publication with Machine translation for CN-110220338-A, Inventor: Sheng el al; Title: "the bracket structure and compressor", Published: Sep. 10, 2019/ (Year: 2019).*
Notice of Allowance in European Appln. No. 23152570.0, mailed on Oct. 2, 2023, 8 pages.
Office Action in Korean Appln. No. 10-2022-0010953, mailed on Sep. 11, 2023, 10 pages (with English translation).
Extended European Search Report in European Appln. No. 23152570.0, mailed on May 15, 2023, 6 pages.

* cited by examiner

*FIG. 16*

| RESPONSE MAGNITUDE [m/s$^2$] | EXISTING | IMPROVED |
|---|---|---|
| AXU | 2.6 | 2.4 |
| AXL | 3.7 | 0.6 |
| AZ | 49.9 | 27.8 |
| Shaft-X | 1.0 | 0.6 |
| Shaft-Y | 0.7 | 0.4 |

ACCUMULATOR FIXING DEVICE FOR COMPRESSOR AND COMPRESSOR HAVING THE SAME

CROSS-REFERENCE TO RELATED APPLICATION

Pursuant to 35 U.S.C. § 119(a), this application claims the benefit of the earlier filing date and the right of priority to Korean Patent Application No. 10-2022-0010953, filed on Jan. 25, 2022, the contents of which are incorporated by reference herein in their entirety.

TECHNICAL FIELD

The present disclosure relates to an accumulator fixing device for a compressor having a bracket structure capable of improving noise characteristics, and a compressor having the same.

BACKGROUND

In general, a compressor is used for a vapor compression refrigeration cycle (hereinafter, abbreviated as a refrigeration cycle) in a refrigerator or an air-conditioner. The compressor may be classified into a reciprocating type, a rotary type, a scroll type, etc. according to a method of compressing a refrigerant.

An accumulator may be installed at a suction side of a compressor to separate a refrigerant into a gas refrigerant and a liquid refrigerant and restrict the liquid refrigerant from flowing into a compression chamber. The accumulator can be mainly used with compressors of direct suction type, such as rotary compressors that normally suction refrigerant directly.

Compressors may be classified into a low-pressure compressor and a high-pressure compressor according to a refrigerant connection relationship between a refrigerant suction pipe and a compression unit. The low-pressure compressor is configured such that the refrigerant suction pipe communicates with an internal space of a shell to be indirectly connected to the compression unit whereas the high-pressure compressor is configured such that the refrigerant suction pipe is directly connected to the compression unit through the shell.

In the low-pressure compressor, as the refrigerant passing through the refrigerant suction pipe flows through the internal space of the shell, the refrigerant may be divided into liquid refrigerant and gas refrigerant. Accordingly, the low-pressure compressor does not need a separate accumulator at an upstream side of the compression unit.

In the high-pressure compressor, as the refrigerant passing through refrigerant suction pipe is directly supplied to the compression unit, liquid refrigerant may be introduced into the compression unit together with gas refrigerant. Accordingly, in the high-pressure compressor, a separate accumulator may be disposed at an upstream side of the compression unit to restrict the liquid refrigerant from flowing into the compression unit.

Typically, an accumulator is disposed at one side of the compressor. A refrigerant connection pipe is disposed at an upper end of the accumulator as an inlet so as to be connected to an outlet of an evaporator through a refrigerant pipe, and a refrigerant passage pipe is disposed at a lower end of the accumulator as an outlet so as to be fixed to a compressor through a refrigerant suction pipe. A middle portion of the accumulator is fixed to the compressor by a fixing bracket that surrounds the accumulator.

In related art, a middle shell of an air-conditioner rotary compressor is manufactured for the purpose of reducing manufacturing cost, while improving roundness or cylindricity with almost no machining by plastic working such as a roll bending step, shrinking step, shell welding step, brushing step, primary expanding step, side cutting step, piercing step, burring step, bracket welding step, brazing step, and secondary expanding step.

In addition, in related art, a fixing structure of an accumulator for a compressor provides a fixing unit welded and fixed between a compressor. In the related art, a housing includes a fixed plate configured to be welded to an outer periphery of the accumulator and a welding rod protruding outwardly from a welded portion of the accumulator to restrict the welded portion from being melted and allowing a front end of the fixed plate to be bonded thereto.

The accumulator fixing structure disclosed in the above related art have a simple shape for merely welding. Further, a response of this accumulator is considerably deteriorated. Moreover, these existing welded brackets are merely for fixing the accumulator and are quite vulnerable to noise caused by vibration of the accumulator.

In addition, in related art, an accumulator fixing device for a compressor provides a bracket that is integrally formed by bending an accumulator body to improve productivity. Further, in this related art, an accumulator is fixed by fastening a bolt to a fixed member mounted on an outer circumferential surface of a closed container. In such a fixing device, the fixed member protruding to have a certain height on one side of a compressor and having a bolt fastening hole is mounted, and a bracket is integrally formed so that the accumulator may be fastened to the fixed member by a bolt.

The accumulator fixing device for a compressor based on the bolt method may considerably worsen a response of the accumulator due to the durability of the coupling structure as in the related art, and the device may be considerably vulnerable to noise due to vibration of the accumulator.

In addition, because the bracket for fixing the accumulator to the housing has a complicating structure for fixing by bolts, the number of components and the time needed for the assembly operation increase.

Therefore, an accumulator structure is desired that is capable of reducing transmission of excitation force of a compressor and reducing the occurrence of noise resulting from vibration of an accumulator, while applying the shape of the existing welded bracket.

SUMMARY

The present disclosure has been devised to solve the above problems. For example, the present disclosure provides an accumulator for a compressor fixed by a bracket structure capable of improving noise characteristics.

In addition, the present disclosure also provides an accumulator structure for a compressor having a bracket capable of reducing transmission of excitation force of a compressor and reducing the occurrence of vibration of an accumulator or a resultant occurrence of noise.

In addition, the present disclosure also provides an accumulator for a compressor having a structure including a bracket capable of improving noise characteristics and vibration, while applying an existing welded bracket.

In addition, the present disclosure also provides an accumulator structure for a compressor capable of reducing transmission of excitation force of a compressor and reducing the occurrence of vibration of an accumulator or a resultant occurrence of noise, while applying an existing welded bracket.

Particular implementations of the present disclosure provide a device for fixing an accumulator for a compressor. The device includes a bracket body, a first arm extending from the bracket body and coupled to the accumulator, and a second arm extending from the bracket body and coupled to a housing of the compressor. The bracket body has a surface facing the compressor and defines a cavity at the surface. The cavity is configured to reduce vibration generated and transmitted from the compressor.

In some implementations, the device can optionally include one or more of the following features. The first arm may include two first arm portions positioned at opposite sides of the bracket body respectively. The bracket body may include a support portion supporting the two first arm portions. The two first arm portions may be connected to a side of the support portion that is opposite to the surface. The cavity of the bracket body may extend between opposite ends of the bracket body. The second arm may include two second arm portions being connected to each other through the support portion. The cavity of the bracket body may be positioned between the two second arm portions. The support portion may include a first support portion and a second support portion that extend in opposite directions from the bracket body. The cavity of the bracket body may be positioned between the first support portion and the second support portion. The bracket body may be positioned between the first support portion and the second support portion. The bracket body may have a cavity inner surface that defines the cavity. A first inner surface of the first support portion and a second inner surface of the second support portion may define the cavity. The first inner surface and the cavity inner surface may define an obtuse angle with each other. The second inner surface and the cavity inner surface may define an obtuse angle with each other. The first inner surface and the cavity inner surface may define a right angle to each other. The second inner surface and the cavity inner surface may define a right angle to each other. The first inner surface and the second inner surface may be connected to each other and define a curved surface to thereby define the cavity of the bracket body in an arch structure. A horizontal width of the second arm may be wider than a horizontal width of each of the first support portion and the second support portion. The first arm may include a first member protruding from the bracket body and a second member extending from the first member at a predetermined angle relative to the first member. The second member may extend from an end portion of the first member and may be curved outwardly with respect to the first member. The second member may have a wider width in a vertical direction than the first member. The first arm may extend from the bracket body in a first direction. The second arm may extend from the bracket body in a second direction crossing the first direction. The second arm may include two second arm portions that extend in upward and downward directions respectively. The cavity may be positioned between the two second arm portions. A height of the device may be defined by free ends of the two second arm portions. A vertical width of the cavity may be 20% or more and 50% or less of the height of the device. The second arm may include two second arm portions that extend in upward and downward directions respectively. The cavity may be positioned between the two second arm portions. A height of the device may be defined by free ends of the two second arm portions. A height of the first arm may be smaller than the height of the device. The second arm may have a coupling surface coupled to the housing of the compressor. A first depth of the device may be defined from the coupling surface of the second arm to an end portion of the first arm in a direction. A second depth of the cavity may be defined in the direction. A ratio of the first depth to the second depth may be 5 to 8:1. The first arm may include a coupling surface. The coupling surface may have a curved surface that corresponds to a shape of the accumulator and may be configured to couple to the accumulator. The coupling surface of the first arm may define a hole or a concave recess for welding. The second arm may have a coupling surface. The coupling surface may have a curved surface that corresponds to a shape of the housing of the compressor and may be configured to couple to the compressor. The coupling surface of the second arm may define a hole or a concave recess for welding. The first arm may be welded to the accumulator, and the second arm may be welded to the compressor.

Particular implementations of the present disclosure provide a compressor that includes a housing defining an internal space being sealed, an electric unit provided in the internal space, a compression unit provided in the internal space and configured to be driven by the electric unit to compress refrigerant and discharge refrigerant to the internal space of the housing, an accumulator disposed outside the housing, supported by the housing, and connected to the compression unit through the housing, the accumulator being configured to separate liquid refrigerant from the refrigerant suctioned into the compressor, and an accumulator fixing device coupled between the housing and the accumulator and coupling the accumulator to the housing.

In some implementations of the present disclosure, an accumulator fixing device for a compressor includes a bracket body, a first arm portion extending from the bracket body and coupled to an accumulator, and a second arm portion extending from the bracket body and coupled to a housing of a compressor. The bracket body has a cavity formed concavely on one surface facing the compressor to reduce vibration generated and transmitted from the compressor.

Accordingly, although the shape of an existing welded bracket is used, transmission of an excitation force from the housing of the compressor may be reduced, and vibration of the accumulator or resultant occurrence of noise may be reduced.

The first arm portion may be provided as two first arm portions respectively on both sides of the bracket body. The bracket body may include a support portion supporting the two first arm portions, and the support portion may support the two first arm portions to be connected from the opposite side of the one surface.

In some implementations, the cavity may penetrate through both ends of the bracket body.

In addition, the second arm portion may be provided as two second arm portions respectively disposed with the cavity therebetween. The two second arm portions may be connected to each other by the support portion.

In some implementations, the support portion may include first and second support portions extending in two directions from the bracket body with the cavity therebetween.

The bracket body may be provided between the first and second support portions, and may have a cavity inner surface forming the cavity.

Accordingly, the present disclosure may reduce the transmission of the excitation force from the housing of the compressor while applying the shape of the conventional welded bracket, and reduce the vibration of the accumulator or the generation of noise accordingly.

In addition, each of inner surfaces of the first and second support portions, which defines the cavity, and the cavity inner surface may form an obtuse angle with each other.

Each of inner surfaces of the first and second support portions, which defines the cavity, and the cavity inner surface may form a right angle to each other.

Inner surfaces of the first and second support portions, which defines the cavity, may be connected to each other and form a curved surface, so that the bracket body forms the cavity in an arch structure.

A horizontal width of the second arm portion may be wider than a horizontal width of each of the first and second support portions.

The first arm portion may include a first member formed to protrude from the bracket body in one direction, and a second member extending from the first member to be bent by a predetermined angle.

The second member may be bent outwardly with respect to the first member from an end portion of the first member.

Accordingly, as the second member is bent outwardly with respect to the first member, a contact angle between contact surfaces at which the two second members contact the accumulator, respectively, may become wider.

In addition, the second member may have a wider width in a vertical direction than the first member.

Accordingly, the accumulator may be more stably coupled to the bracket, thereby providing an advantageous structure capable of reducing noise and vibration.

The first arm portion may extend in one direction from the bracket body, and the second arm portion may extend in the other direction crossing the one direction from the bracket body.

The second arm portion may be provided as two second arm portions to be arranged to extend in upward and downward directions with the cavity therebetween, so that a height of the fixing device is formed between upper and lower ends of the two second arm portions, and a vertical width of the cavity may be 20% or more and 50% or less of the height of the fixing device.

Accordingly, the support portion, which defines the cavity, may form a structure connecting the first arm portion and the second arm portion, thereby canceling a response between the first arm portion and the second arm portion and thus reducing noise and vibration.

The second arm portion may be provided as two second arm portions that are arranged to extend in upward and downward directions, respectively, with the cavity therebetween. Thus, a height of the fixing device is measured between upper and lower ends of the two second arm portions. A height of the first arm portion may be lower than the height of the fixing device.

The second arm portion may have a coupling surface coupled to the housing of the compressor. A depth d1 of the fixing device is defined from the coupling surface of the second arm portion to an end portion of the first arm portion in one direction, and a depth d2 of the cavity is defined in the one direction. The ratio of the depth d1 to the depth d2 may be d1:d2=5 to 8:1.

The first arm portion may include a coupling surface formed as a curved surface that corresponds to a shape of the accumulator and is coupled to the accumulator.

A hole or a concave recess for welding may be formed on a rear surface of the coupling surface of the first arm portion.

The second arm portion may have a coupling surface formed as a curved surface that corresponds to a shape of the housing of the compressor and is coupled to the housing of the compressor.

A hole or a concave recess for welding may be formed on a rear surface of the coupling surface of the second arm portion.

The first arm portion may be welded to the accumulator, and the second arm portion may be welded to the compressor.

Some implementations of the present disclosure provide a compressor including an accumulator fixing device. The compressor may include a housing forming an exterior and having a sealed internal space, an electric unit provided in the internal space, a compression unit provided in the internal space and driven by the electric unit to compress a refrigerant and discharge the compressed refrigerant to the internal space of the housing, and an accumulator that is disposed outside the housing, that is supported by the housing, that is connected to the compression unit through the housing, and that is configured to separate a liquid refrigerant from the refrigerant suctioned into the compressor. The compressor may further include an accumulator fixing device coupled between the housing and the accumulator and configured to couple the accumulator to the housing.

BRIEF DESCRIPTION OF THE DRAWINGS

FIG. 16 is a table illustrating response magnitudes in related art and implementations of the present disclosure.

DETAILED DESCRIPTION

Figure 1:
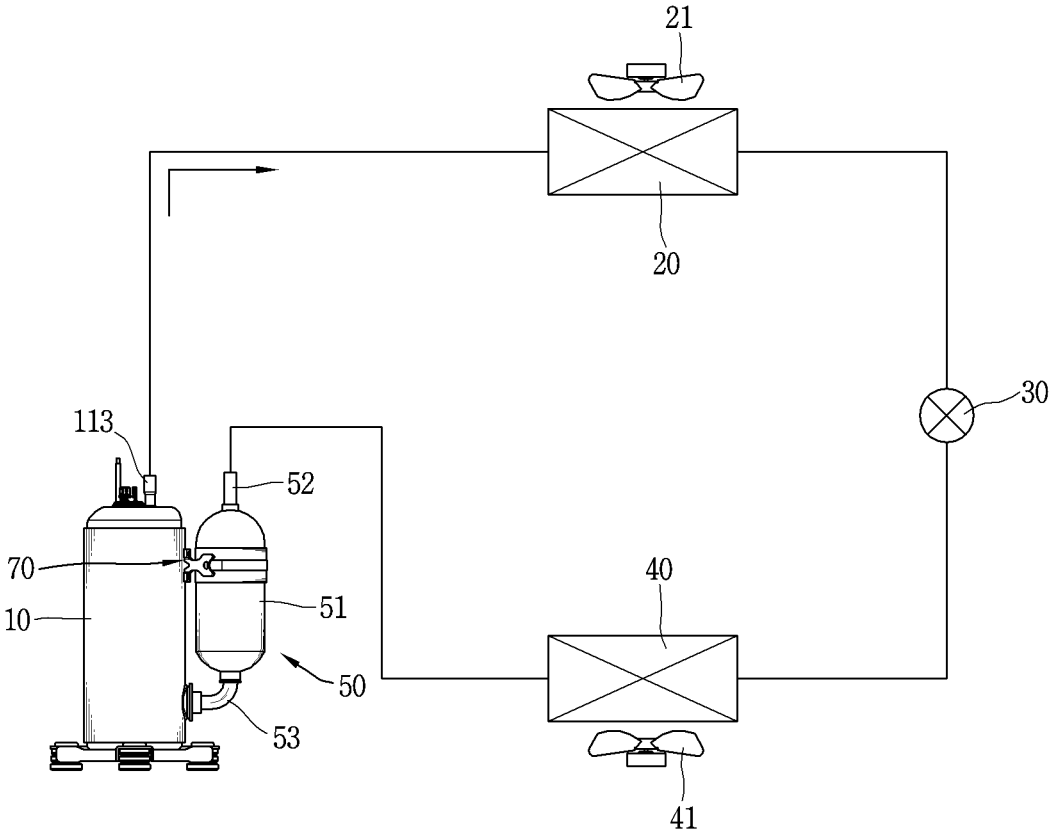
FIG. 1 is a conceptual diagram illustrating a refrigeration cycle to which a rotary compressor of the present disclosure is applied.

For the sake of brief description with reference to the drawings, the same or like components will be provided with the same reference numbers, and a redundant description thereof will not be repeated.

In addition, structures and principles in one implementation may be similarly applied to another implementation to the extent that they are compatible and not contradictory.

A singular representation may include a plural representation unless it represents a definitely different meaning from the context.

The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

Hereinafter, an accumulator fixing device 70 for a compressor and a compressor 10 including the same according to the present disclosure will be described in detail based on implementations shown in the accompanying drawings.

For reference, the accumulator fixing device 70 for a compressor according to the present disclosure may also be applied to a vertical compressor in which a housing 110 constituting the appearance of the compressor is installed in a longitudinal direction and a horizontal compressor in which the housing 110 is installed in a transverse direction.

In addition, the accumulator fixing device 70 for a compressor according to the present disclosure may also be applied to not only a rotary compressor 10 in which a compression unit 130 is formed by a roller and a vane but also a scroll compressor in which a plurality of scrolls is engaged with each other to form the compression unit 130.

In addition, although the present disclosure is described based on the rotary compressor 10, the accumulator fixing device 70 according to the present disclosure may be equally applied to a compressor to which an accumulator 50 is applied, such as a high-pressure compressor in which a refrigerant suction pipe is directly connected to the compression unit 130, as well as the rotary compressor 10 and the scroll compressor.

In the present disclosure, the general rotary compressor 10 will be mainly described. In the rotary compressor 10, a vane is inserted into a vane slot formed in a cylinder and slidably contacts an outer circumferential surface of a roller.

FIG. 1 is a conceptual diagram illustrating a refrigeration cycle to which the rotary compressor 10 of the present disclosure is applied.

Referring to FIG. 1, a refrigeration cycle is used for a rotary compressor 10 according to implementations of the present disclosure. In the refrigeration cycle, a compressor 10, a condenser 20, an expander 30, an evaporator 40, and an accumulator 50 define a closed loop. That is, the condenser 20, the expander 30, the evaporator 40, and the accumulator 50 may be sequentially connected to a discharge side of the compressor 10, and a discharge side of the evaporator 40 may be connected to a suction side of the compressor 10 with interposing the accumulator 50 therebetween. Accordingly, refrigerant compressed in the compressor 10 can be discharged toward the condenser 20 and then suctioned back into the compressor 10 sequentially via the expander 30, the evaporator 40, and the accumulator 50. This series of processes can be repeated.

However, since the accumulator 50 is typically disposed adjacent to the suction side of the compressor 10 and serves to separate liquid refrigerant from refrigerant suctioned into the compressor 10, the accumulator 50 may be understood as a component of the compressor other than constituting a part of the refrigeration cycle.

Figure 2:
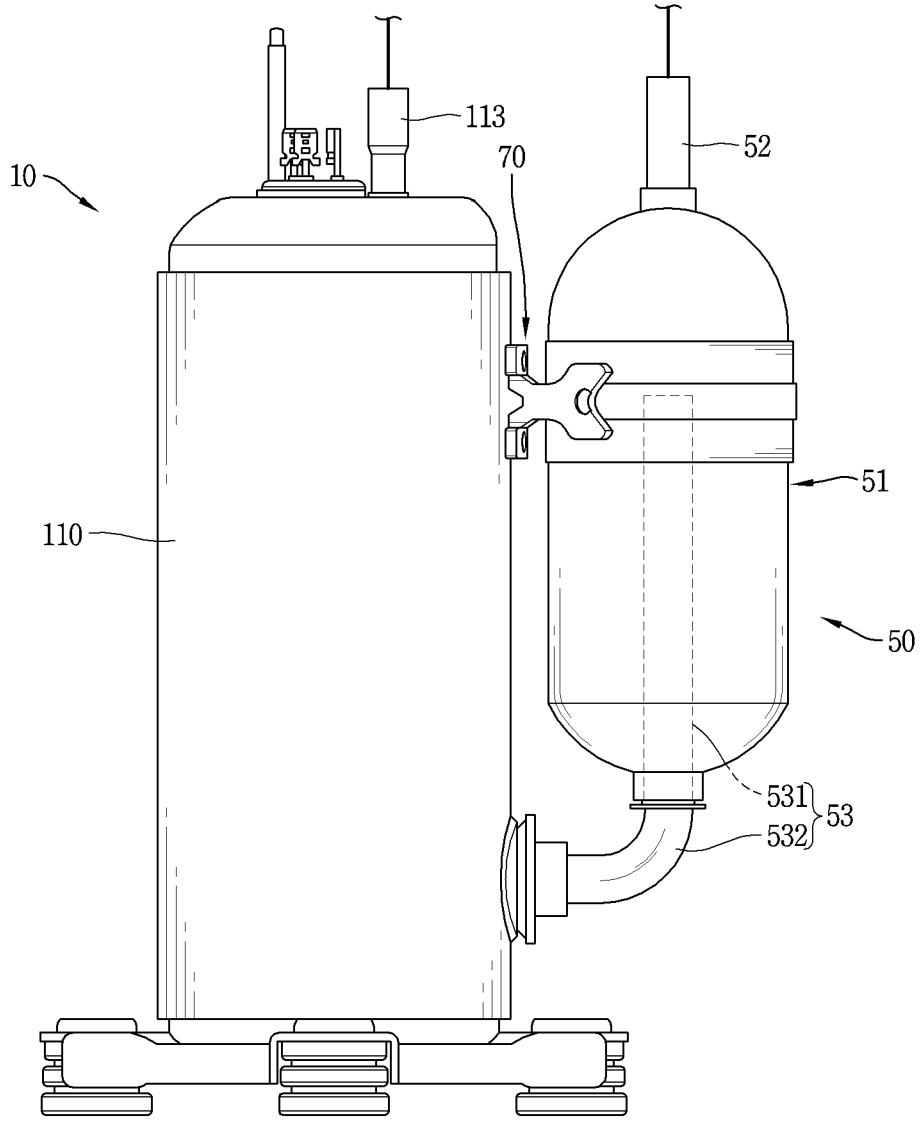
FIG. 2 is a front view illustrating an example structure that couples a rotary compressor to an accumulator using a bracket.
Figure 3:
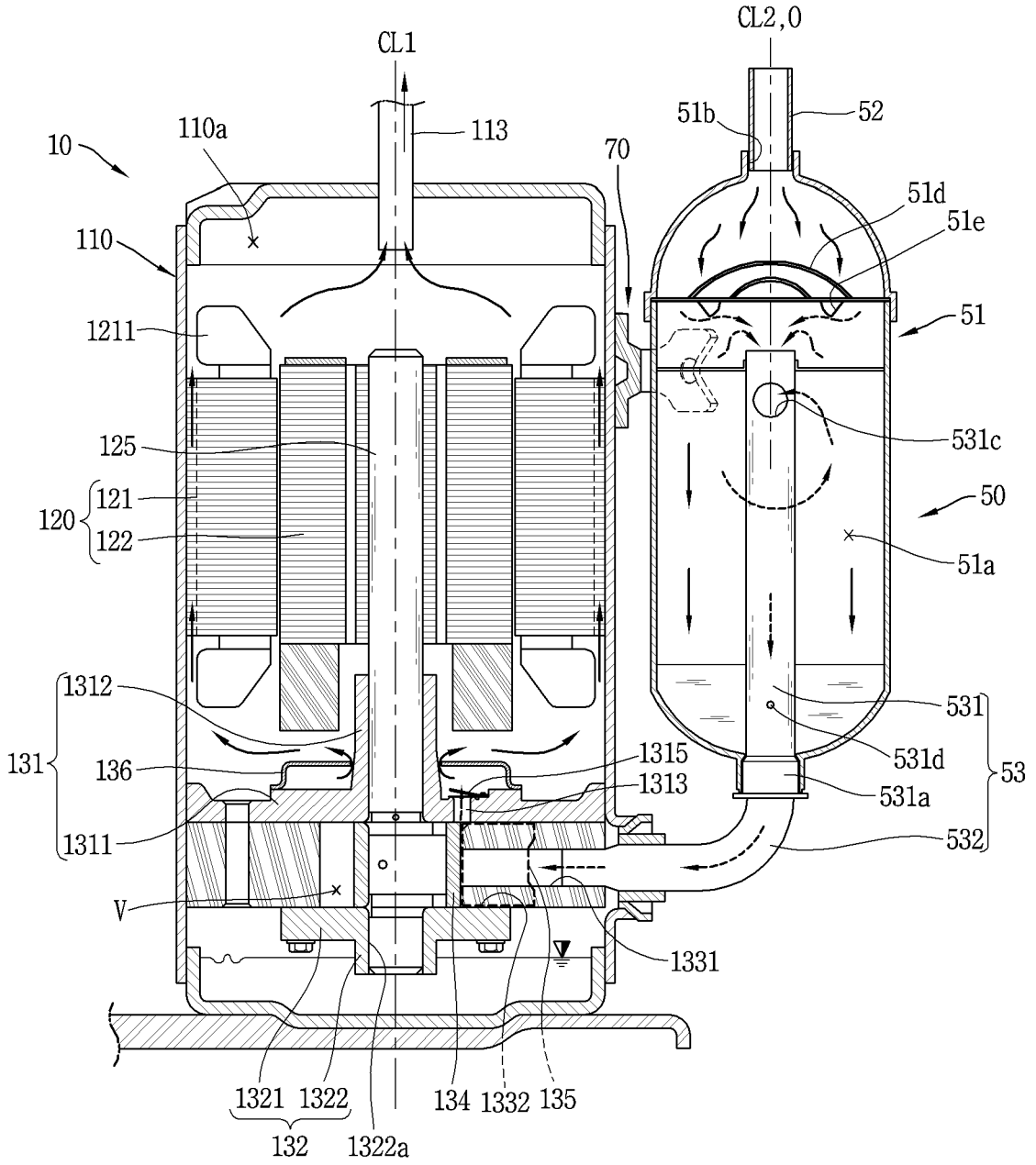
FIG. 3 is a longitudinal cross-sectional view illustrating an example structure that couples a rotary compressor to an accumulator using a bracket.
Figure 4:
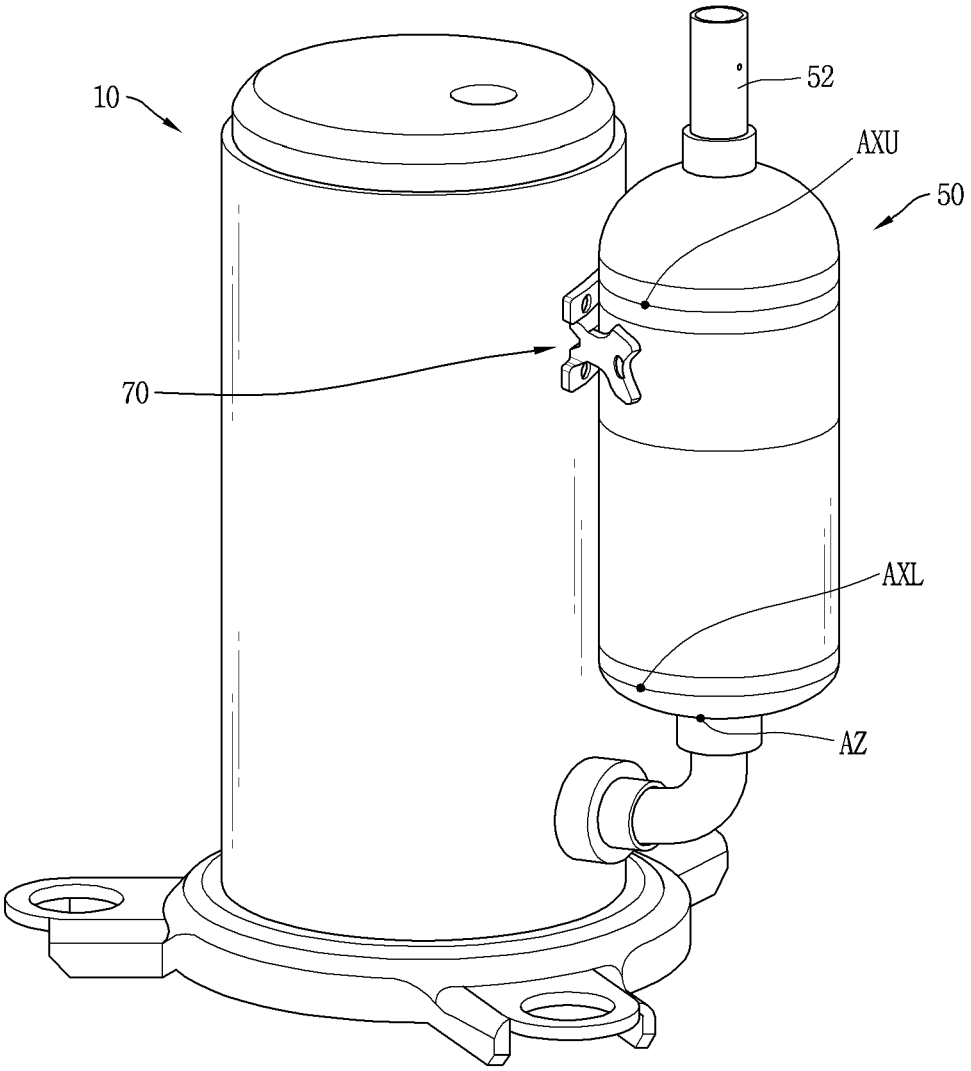
FIG. 4 is a perspective view illustrating an example structure that couples a rotary compressor to an accumulator using a bracket.

FIG. 2 is a front view illustrating an example structure in which the rotary compressor 10 and the accumulator 50 of the present disclosure are fixedly coupled by a bracket. FIG. 3 is a longitudinal cross-sectional view illustrating an example structure in which the rotary compressor 10 and the accumulator 50 are fixedly coupled by a bracket. FIG. 4 is a perspective view illustrating an example structure in which the rotary compressor 10 and the accumulator 50 of the present disclosure are fixedly coupled by a bracket.

Referring to FIGS. 2-4, the rotary compressor 10 of the present disclosure will be described.

Referring to FIG. 3, the rotary compressor 10 according to the present disclosure may include an electric unit 120 and a compression unit 130.

An electric unit 120 is installed in an internal space of the housing 110. As shown in FIG. 3, the electric unit 120 is installed above the compression unit 130.

The compression unit 130 is installed below the electric unit 120. In addition, the compression unit 130 can suction a refrigerant, compress the refrigerant, and discharge the compressed refrigerant to an internal space of the housing 110.

The electric unit 120 and the compression unit 130 are mechanically connected by a rotating shaft 125, and the rotating shaft 125 may transmit a rotational force generated by the electric unit 120 to the compression unit 130.

The rotary compressor 10 of the present disclosure may further include the housing 110 accommodating the electric unit 120 and the compression unit 130.

The internal space 110*a* of the housing 110 is sealed, and a refrigerant suction pipe 532 is coupled to a lower portion. As described herein, the refrigerant suction pipe 532 forms a part of a refrigerant suction pipe 53 and is connected to the outlet side of the accumulator 50. A refrigerant discharge pipe 113 connected to a condenser is coupled to an upper portion of the housing 110. The refrigerant discharge pipe 113 may be coupled on the same axis as that of the rotating shaft 125 or disposed to be spaced apart from the rotating shaft 125 on the same axis.

The refrigerant suction pipe 532 passes through the housing 110 and is directly connected to a suction port 1331 of a cylinder 133, and the refrigerant discharge pipe 113 passes through the housing 110 and communicates with the internal space 110*a*. Accordingly, the compressor forms a high-pressure compressor in which the internal space 110*a* of the housing 110 has a discharge pressure.

The accumulator 50 is installed in the refrigerant suction pipe 532. More specifically, as shown in FIG. 3, the refrigerant passage pipe 531 of the accumulator 50 is connected to the refrigerant suction pipe 532.

Also, the accumulator 50 is disposed between the evaporator 40 and the compressor 10.

The accumulator 50 may include a casing 51, a refrigerant connection pipe 52, and the refrigerant suction pipe 53.

The casing 51 is provided with a refrigerant accommodating space 51*a*. Referring to FIGS. 2 to 4, the casing 51 may be formed of a single cylindrical body, but is not necessarily limited thereto, and may be formed of a plurality of members covering the top and bottom.

The refrigerant connection pipe 52 is coupled through an upper end of the casing 51 and communicates with the refrigerant accommodating space 51*a*.

In addition, the refrigerant suction pipe 53 is coupled through a lower end of the casing 51 and communicates with the refrigerant accommodating space 51*a*.

To this end, a coupling hole to which the refrigerant connection pipe 52 and the refrigerant suction pipe 53 are coupled may be provided at the upper end and the lower end of the casing 51, respectively.

The refrigerant connection pipe 52 connects an outlet of an evaporator 40 to an inlet of the accumulator 50, and the refrigerant suction pipe 53 connects an outlet of the accumulator 50 to a suction side of the compressor 10.

Accordingly, the refrigerant including gas refrigerant and liquid refrigerant flows from the evaporator 40 to the accumulator 50 through the refrigerant connection pipe 52, and the introduced refrigerant is separated from the liquid refrigerant through the suction pipe 53 and suctioned into the compression chamber V of the compressor 10.

More specifically, among the refrigerants introduced into the internal space of the casing 51 through the refrigerant connection pipe 52 on the inlet side of the accumulator 50, the gas refrigerant passes through an oil separation screen 51*d* and is directly suctioned into the compression chamber V in the cylinder 133 through the refrigerant suction pipe 53 on the outlet side. Meanwhile, the liquid refrigerant is filtered by the oil separation screen 51*d*, passes through a screen hole 51*e*, is accumulated at the bottom of the casing 51. The liquid refrigerant accumulated at the bottom of the casing 51 is vaporized by ambient heat to rise and be suctioned into the compression chamber V in the cylinder 133 through the refrigerant suction pipe 53 on the outlet side.

Meanwhile, the electric unit 120 of the rotary compressor 10 of the present disclosure includes a stator 121 and a rotor 122.

The electric unit 120 may be a general rotating motor or a driving motor.

The stator 121 is fixed inside the housing 110.

The rotor 122 is rotatably inserted and installed inside the stator 121. A stator coil 1211 is wound around the stator 121, and a permanent magnet is inserted into the rotor 122.

In addition, the rotating shaft 125 is press-fitted to the center of the rotor 122.

The compression unit 130 may include a main bearing 131, a sub-bearing 132, a cylinder 133, a roller 134, and a vane 135.

The main bearing 131 is fixedly coupled to an inner circumferential surface of the housing 110, and a sub-bearing 132 supporting the rotating shaft 125 together with the main bearing 131 is provided on a lower side of the main bearing 131 with the cylinder 133 therebetween.

In the case of a vertical compressor, the main bearing 131 may be referred to as an upper bearing installed above with respect to the cylinder 133 having the compression chamber V to support the rotating shaft 125, and the sub-bearing 132 may be referred to as a lower bearing installed below with respect to the cylinder 133 including the compression chamber V to support the rotating shaft 125.

The main bearing 131 may include a main plate portion 1311 and a main bush portion 1312.

The main plate portion 1311 covers an upper surface of the cylinder 133. In addition, the main plate portion 1311 forms the compression chamber V together with the cylinder 133 and the sub-plate portion 1321.

The main bush portion 1312 extends from the main plate portion 1311 in an axial direction of the rotating shaft 125 to support the rotating shaft 125.

The main plate portion 1311 is formed in a disk shape so that an outer circumferential surface is coupled to an inner circumferential surface of the housing 110.

For example, the main plate portion 1311 may have an outer circumferential surface coupled to an inner circumferential surface of the housing 110 by press-fitting or welding.

A discharge port 1313 for discharging the refrigerant compressed in the compression chamber V is formed in the main plate 1311. A discharge valve 1315 for opening and closing the discharge port 1313 is installed at an end portion of the discharge port 1313.

The sub-bearing 132 may include the sub-plate portion 1321 and the sub-bush portion 1322.

The sub-plate portion 1321 is coupled to a lower surface of the cylinder 133. In addition, the sub-plate portion 1321 forms the compression chamber V together with the cylinder 133 and the main plate portion 1311.

The sub-bush portion 1322 may extend from the sub-plate portion 1321 in the axial direction of the rotating shaft 125 to support the rotating shaft 125.

The sub-plate portion 1321 may be formed in a disk shape and may be bolted to the main plate portion 1311 together with the cylinder 133.

In addition, a sub-shaft receiving hole 1322*a* is formed in the sub-bush portion 1322. The rotating shaft 125 can be supported through the sub-shaft receiving hole 1332*a*.

The cylinder 133 is provided between the main bearing 131 and the sub-bearing 132. Referring to FIG. 3, the cylinder 133 is covered by the upper main bearing 131 and the lower sub-bearing 132 to form the compression chamber V. The compression chamber V of the cylinder 133 is provided with a suction space that communicates with the suction port 1331 by the vane 135, and communicates with a discharge space that communicates with the discharge port 1313.

For example, the cylinder 133 is fixed to the main bearing 131 together with the sub-bearing 132 by bolting.

The cylinder 133 is preferably formed in an annular shape with an empty interior to form the compression chamber V.

In addition, one side of the cylinder 133 is provided with the suction port 1331 that is formed to penetrate through in a lateral direction between the outer circumferential surface and the inner circumferential surface.

A vane slot 1332 is provided at one side of the suction port 1331 and defines a space into which the vane 135 is slidably inserted.

In the illustrated example, the vane slot 1332 is formed in the cylinder 133 on one side of the suction port 1331.

However, the present disclosure is not necessarily limited thereto, and the vane slot 1332 may be provided in the roller 134.

In this case, the vane slot 1332 may be formed in a radial direction in the roller 134, and the vane 135 may be movably installed in the vane slot 1332 of the roller 134 to contact an inner periphery of the cylinder 133 so that the refrigerant may be compressed.

The compression chamber V of the cylinder 133 is provided with a roller 134 that is eccentrically coupled to the rotating shaft 125 and compresses the refrigerant while rotating. A vane 135 contacts the roller 134 and divides the compression chamber V into a suction chamber and a compression chamber together with the roller 134. The vane 135 is slidably inserted into the vane slot 1332 of the inner wall of the cylinder 133.

The roller 134 is formed in an annular shape and is rotatably coupled to an eccentric portion of the rotating shaft 125, and the vane 135 is slidably inserted into the vane slot 1332 of the cylinder 133 to contact an outer circumferential surface of the roller 134.

In the illustrated example, the vane slot 1332 is formed in the cylinder 133 on one side of the suction port 1331. However, the present disclosure is not necessarily limited thereto, and the vane slot 1332 may be provided on the roller 134.

In this case, the vane slot 1332 may be formed in a radial direction on the roller 134, and the vane 135 is movably installed in the vane slot 1332 of the roller 134 to contact the inner periphery of the cylinder 133 so that the refrigerant may be compressed.

Meanwhile, in FIG. 3, a discharge muffler 136 is installed on an upper surface of the main plate 1311.

Figure 5:
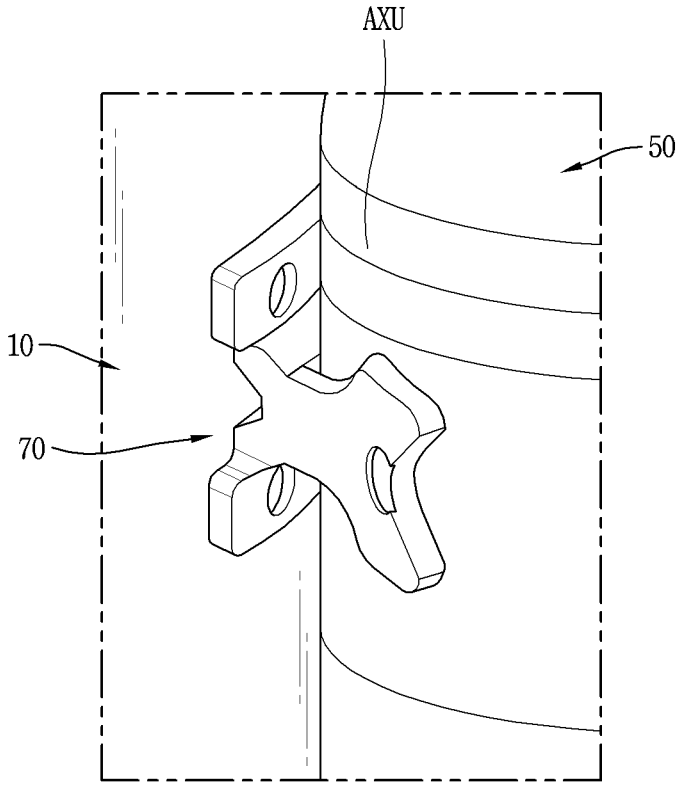
FIG. 5 is an enlarged view of the structure that couples a rotary compressor to an accumulator using a bracket.
Figure 6:
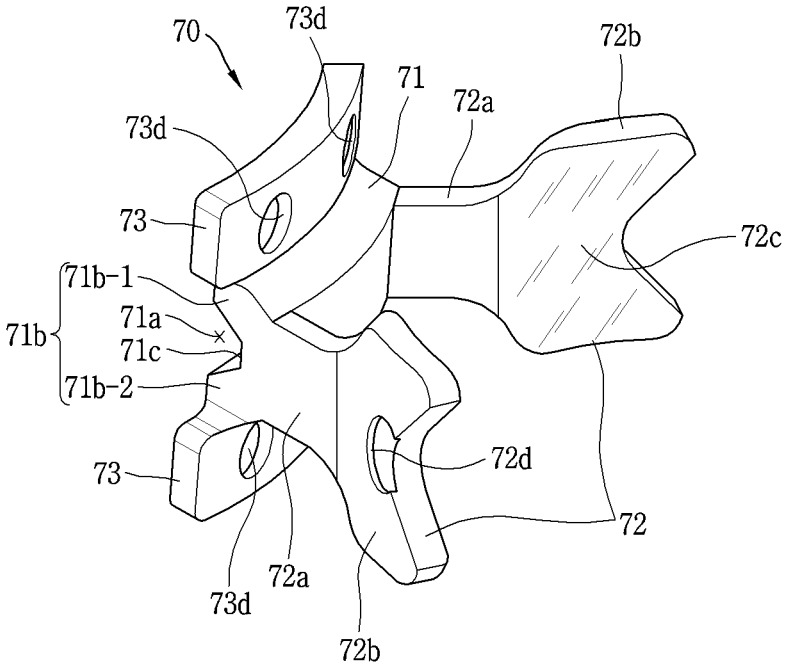
FIG. 6 is a perspective view illustrating an example bracket.
Figure 7:
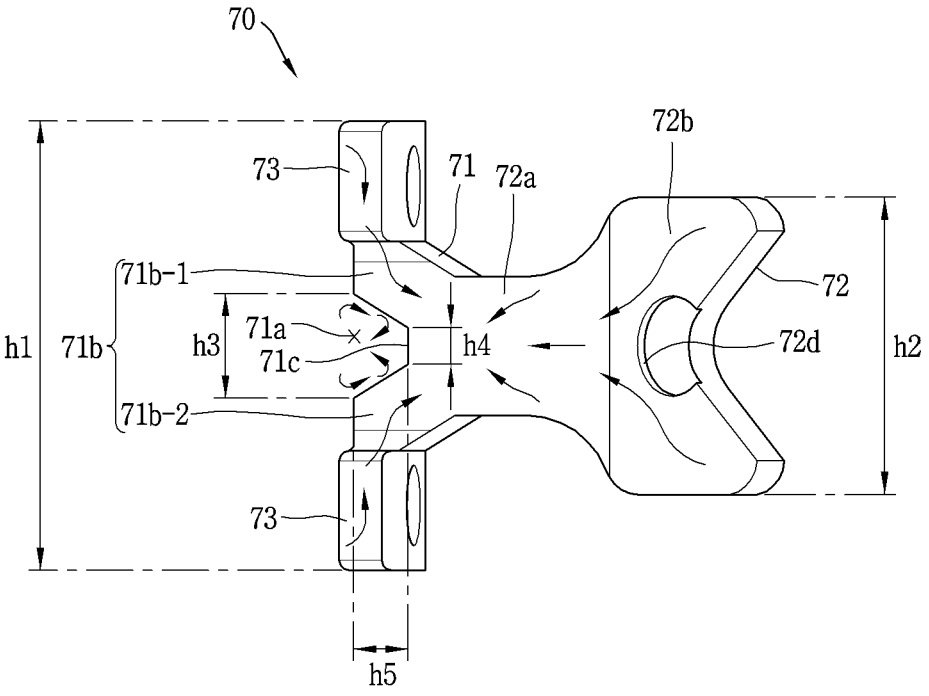
FIG. 7 is a side view of the bracket of FIG. 6.
Figure 8:
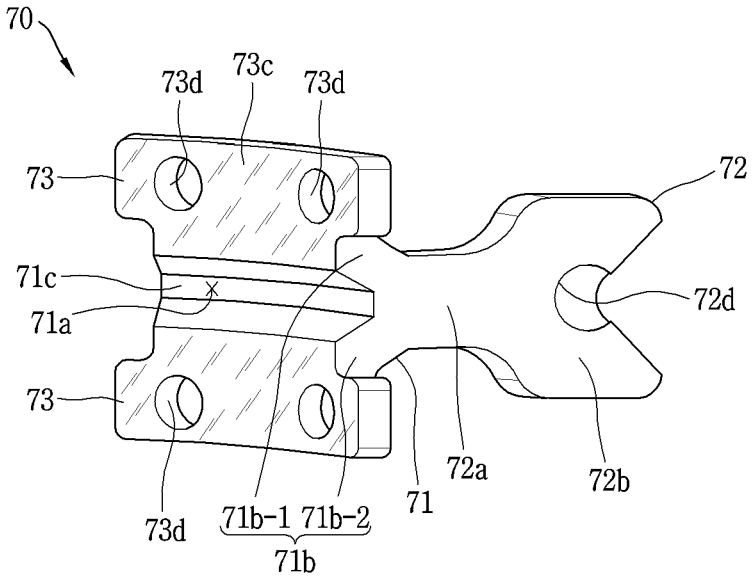
FIG. 8 is another perspective view of the bracket of FIG. 6.
Figure 9:
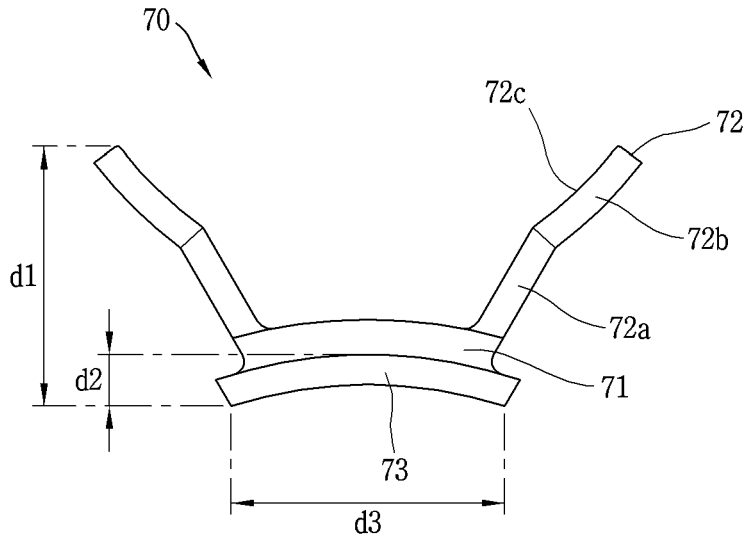
FIG. 9 is a plan view of the bracket of FIG. 6.
Figure 10:
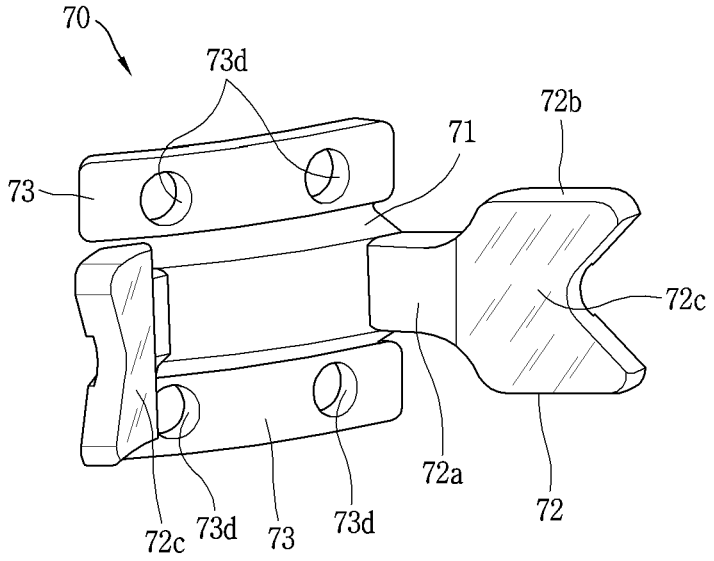
FIG. 10 is another perspective view of the bracket of FIG. 6.

FIG. 5 is an enlarged view of the structure in which the rotary compressor 10 and the accumulator 50 of the present disclosure are fixedly coupled by a fixing device 70. FIG. 6 is a perspective view illustrating the fixing device 70 according to an implementation of the present disclosure. FIG. 7 is a side view of the structure of FIG. 6. FIG. 8 is another perspective view viewed of the structure of FIG. 6. FIG. 9 is a plan view of the structure of FIG. 6. FIG. 10 is another perspective view of the structure of FIG. 6.

Hereinafter, an accumulator fixing device 70 for a compressor according to an implementation of the present disclosure will be described with reference to FIGS. 5 to 10.

The accumulator fixing device 70 for a compressor of the present disclosure includes a bracket body 71 and first and second arm portions 73.

In addition, the accumulator fixing device 70 may be a bracket.

The first arm portion 72 extends from the bracket body 71 and is coupled to the accumulator 50.

In FIGS. 6 and 7, one direction may be defined as a direction toward the right from the bracket body 71.

The second arm portion 73 extends from the bracket body 71 and is coupled to the housing 110 of the compressor.

In FIGS. 6 and 7, a direction crossing one direction may be defined as a direction toward the upper side and the lower side from the bracket body 71.

In addition, the bracket body 71 is provided with a cavity 71*a*. The cavity 71*a* is concavely formed in the bracket body 71 on one surface facing the compressor.

Referring to FIGS. 6 to 8, the cavity 71*a* may be formed on one surface of the bracket body 71. One surface of the bracket body 71 on which the cavity 71*a* is formed is a surface facing the housing 110 of the compressor, and may be a surface on the side where a coupling surface 73*c* of the second arm portion 73 is provided.

The cavity 71*a* is formed on one surface of the bracket body 71 to be concave in a direction in which the first arm portion 72 extends with respect to the coupling surface 73*c* of the second arm portion 73.

In addition, the cavity 71*a* may be formed to penetrate through both ends of the bracket body 71, as shown in FIG. 8.

The cavity 71*a* may be formed such that a side cross-section thereof has a trapezoidal shape with reference to FIG. 7.

In addition, referring to FIG. 8, the cavity 71*a* is formed over the left and right both ends of the bracket body 71.

Two first arm portions 72 may be formed. In this case, the two first arm portions 72 may be provided on both sides of the bracket body 71, respectively.

Each of the two first arm portions 72 has a coupling surface 72*c* coupled and fixed to an outer periphery of the accumulator 50. For example, the coupling surface 72*c* of each of the two first arm portions 72 is coupled to the outer periphery of the casing 51 of the accumulator 50.

The coupling surface 72*c* of the first arm portion 72 may be formed in a curved surface to correspond to the shape of the accumulator 50 and to be coupled thereto.

Meanwhile, the coupling surface 73*c* of the second arm portion 73 may also be formed in a curved shape to correspond to the shape of the housing 110 of the compressor 10 and be coupled thereto.

The coupling surface 72*c* of the first arm portion 72 is provided on the second member 72*b*, and a hole or concave recess 72*d* for welding is formed on a rear surface of the coupling surface 72*c* of the second member 72*b*.

A welding rod is disposed in the hole or concave recess 72*d*, and welding is performed so that the coupling surface 72*c* of the second member 72*b* and the accumulator 50 are welded.

FIGS. 6 to 8 show an example structure in which the concave recess 72*d* is formed on the rear surface of the coupling surface 72*c* of the second member 72*b*, but a hole may be formed to pass through the coupling surface 72*c*.

Meanwhile, a hole 73*d* or a concave recess for welding may be formed on the rear surface of the coupling surface 73*c* of the second arm portion 73.

A welding rod is disposed in the hole 73*d* or the concave recess, and welding is performed so that the coupling surface 73*c* of the second arm portion 73 and the housing 110 of the compressor 10 are welded.

In FIGS. 6 to 8, the hole 73*d* is formed through the rear surface of the coupling surface 73*c* of the second arm portion 73. However, similarly to the concave recess 72*d* of the first arm portion 72, the concave recess may be formed on the rear surface of the coupling surface 73*c* of the second arm portion 73.

The first arm portion 72 may extend from a surface in which the cavity 71*a* is not formed to the opposite side of the cavity 71*a* in the bracket body 71.

The bracket body 71 may include a support portion 71*b*. The support portion 71*b* forms the cavity 71*a* and supports the two first arm portions 72 to be connected to each other on the opposite side of the one surface.

The support portion 71*b* may include first and second support portions 71*b*-1 and 71*b*-2.

The first and second support portions 71*b*-1 and 71*b*-2 may be formed to extend in two directions with the cavity 71*a* interposed therebetween.

In the present disclosure, the support portion 71*b* forming the cavity 71*a* forms a structure connecting the first arm portion 72 to the second arm portion 73 so that mutual responses of the first arm portion 72 and the second arm portion 73 may be canceled out to thereby reduce noise and vibration.

In FIGS. 6 to 8, the support portion 71*b* is shown, and the first support portion 71*b* is formed at an upper part and the second support portion 71*b* is formed at a lower part. However, the present disclosure is not necessarily limited to this order, and the first support portion 71*b* may be formed at the lower part and the second support portion 71*b* may be formed at the upper part.

A second arm portion 73 is connected to an end portion of each of the first and second support portions 71*b*-1 and 71*b*-2.

First and second support portions 71*b*-1 and 71*b*-2 are connected to the two second arm portions 73, respectively, and the cavity 71*a* is formed between the first and second support portions 71*b*-1 and 71*b*-2. By this structure, noise and vibration transmitted from the second arm portion 73 are reduced by the first and second support portions 71*b*-1 and 71*b*-2 and the cavity 71*a* therebetween.

Referring to FIG. 7, as indicated with arrows, noise and vibration transmitted from the compressor 10 can be transmitted from the second arm portion 73 through the first and second support portions 71*b*-1 and 71*b*-2, and noise and vibration transmitted from the accumulator 50 can be transmitted to the first arm portion 72 to be canceled out from each other. In addition, a portion of the noise and vibration transmitted from the compressor 10 through the cavity 71*a* may be discharged to the outside.

Also, as shown in FIG. 8, a horizontal width of the second arm portion 73 may be wider than a horizontal width of each of the first and second support portions 71*b*-1 and 71*b*-2.

Accordingly, the second arm portion 73 may be more stably coupled to the housing 110 of the compressor 10.

Meanwhile, the bracket body 71 may have a cavity inner surface 71*c*. The cavity inner surface 71*c* may be provided between the first and second support portions 71*b*-1 and 71*b*-2. That is, the cavity 71*a* is formed by the first and second support portions 71*b*-1 and 71*b*-2 and the cavity inner surface 71*c*.

Each of the inner surfaces of the first and second support portions 71*b*-1 and 71*b*-2 forming the cavity 71*a* and the cavity inner surface 71*c* may form an obtuse angle with each other.

Like the first arm portion 72, the second arm portion 73 may be provided as two pieces. The second arm portions 73 may be disposed with a cavity 71*a* interposed therebetween, and may be connected to the other end of the support portion 71*b*.

Meanwhile, the first arm portion 72 may include first and second members 72*a* and 72*b*.

The first member 72*a* protrudes from the bracket body 71 in one direction.

The second member 72*b* is bent by a predetermined angle from the first member 72*a*.

Also, referring to FIG. 6, the second member 72*b* may have a wider width in the vertical direction than the first member 72*a*. Accordingly, the second member 72*b* may be more stably coupled with the accumulator 50.

Referring to FIG. 6, two first arm portions 72 extend in the right direction from both side ends of the support portion 71*b* of the bracket body 71, and a first member 72*a* and a second member 72*b* are sequentially connected to the support portion 71*b* of the bracket body 71.

In addition, FIG. 9 also shows that the second member is bent outwardly with respect to the first member 72*a*.

As the second member 72*b* is bent outwardly with respect to the first member 72*a*, a contact angle between the contact surfaces at which each of the two second members 72*b* contacts the accumulator 50 may be wider.

Accordingly, the accumulator 50 may be more stably coupled to the bracket, thereby providing an advantageous structure capable of reducing noise and vibration.

In FIG. 7, a height h1 of the fixing device, a height h2 of the first arm portion 72, a vertical width h3 of the cavity 71*a*, a height h4 of the cavity inner surface 71*c*, and a depth h5 of the cavity 71*a* are shown.

In some implementations, the height h1 of the fixing device is 17 mm to 27 mm, the width h3 of the cavity 71*a* in the vertical direction is 5.3 mm, the height h4 of the cavity inner surface 71*c* is 1.8 mm, and the depth h5 of the cavity 71*a* may be 3 mm.

As shown in FIG. 7, the height h1 of the fixing device may be understood to be formed between upper and lower ends of two second arm portions 73 as the two second arm portions 73 are disposed to extend in an upward direction and a downward direction, respectively.

The width h3 of the cavity 71*a* in the vertical direction may be a height of the inlet of the cavity 71*a*.

The width h3 of the cavity 71*a* in the vertical direction may be 20% or more of the height of the fixing device. In addition, the width h3 of the cavity 71*a* in the vertical direction may be 50% or less of the height of the fixing device.

In addition, the second arm portion 73 is formed as two pieces that are arranged to extend in the upward and downward directions with the cavity 71*a* interposed therebetween, so that the height h1 of the fixing device may be formed between the upper and lower ends of the two second arm portions 73.

At this time, as shown in FIG. 7, the height h2 of the first arm portion 72 in the vertical direction may be lower than the height h1 of the fixing device.

In addition, in FIG. 9, the depth d1 of the fixing device, the depth d2 of the cavity 71*a*, and the width d3 of the cavity 71*a* in a horizontal direction are expressed.

The depth d1 of the fixing device may be defined as a distance from the coupling surface of the second arm portion 73 to an end portion of the first arm portion 72 in one direction.

In addition, a ratio of the depth d1 of the fixing device to the depth d2 of the cavity may be d1:d2=5 to 8:1.

Accordingly, an excitation force transmitted from the compressor 10 may be reduced, and vibration and noise may be further reduced.

In particular, when the numerically limited structure as described above is reflected, the support portion forming the cavity 71*a* may form a structure connecting the first arm portion 72 to the second arm portion 73 to cancel out mutual responses between the first arm portion 72 and the second arm portion 73, so that noise and vibration may be further reduced.

Figure 15:
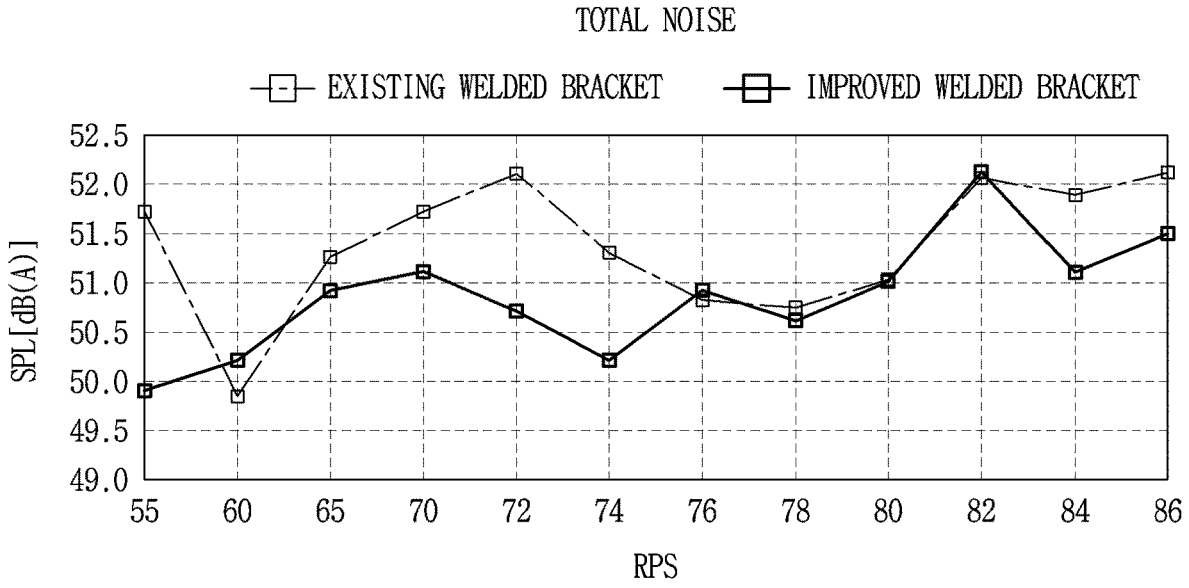
FIG. 15 is a graph illustrating noise discharged from a fixing device of related art and noise discharged from a fixing device of implementations of the present disclosure.

Meanwhile, in FIG. 4, an X-axis upper point, an X-axis lower point, and a Z-axis point of the accumulator 50 are expressed. In FIG. 15, a graph illustrates noise discharged from the accumulator when the fixing device of the related art and the fixing device of the present disclosure are applied. In addition, FIG. 16 shows response magnitudes at each point in the related art and the present disclosure.

Referring to FIGS. 4 and 16, the response magnitude at the X-axis upper point is 2.6 [m/s2] in the related art but is 2.4 [m/s2] in the present disclosure, the response magnitude at the X-axis lower point is 3.7 [m/s2] in the related art but is 0.6 [m/s2] in the present disclosure. In addition, the response magnitude at the Z-axis point is 49.9 [m/s2] in the related art, but 27.8 [m/s2] in the present disclosure. In addition, the response magnitude in the X-axis is 1.0 [m/s2] in the related art, but is 0.6 [m/s2] in the present disclosure, and the response magnitude in the Y-axis is 0.7 [m/s2] in the related art, but is 0.4 [m/s2] in the present disclosure. The response magnitude represents an acceleration at each point.

As described above, it may be confirmed that the response magnitude at each point in FIG. 4 is improved by the accumulator fixing device 70 of the present disclosure, compared to the related art.

Also, referring to FIG. 15, a graph illustrates noise discharged from the accumulator when the fixing device of the related art and the fixing device of the present disclosure are applied, and it may be confirmed that the accumulator emission noise is reduced in a 65 to 74 RPS section and 84 to 86 RPS section.

In particular, it may be confirmed that the existing 52.1 SPL [dB(A)] is reduced to 50.7 SPL [dB(A)] at 72 RPS, and the existing 51.3 SPL [dB(A)] is reduced to 50.2 SPL [dB(A)] at 74 RPS.

The rotary compressor 10 according to the present disclosure may be operated as follows.

When power is applied to the stator 121, the rotor 122 and the rotating shaft 125 can rotate inside the stator 121 and the roller 134 may perform an orbiting motion. In response to the orbiting motion of the roller 134, the suction space defining the compression chamber V may increase in volume. Then, refrigerant may flow from the evaporator 40 into the refrigerant accommodating space 51*a* of the accumulator 50 communicating with the compression chamber V through the refrigerant connection pipe 52.

The refrigerant may be separated into gas refrigerant and liquid refrigerant in the refrigerant accommodating space 51*a* of the accumulator 50. The gas refrigerant may be directly suctioned into the compression chamber V through the refrigerant suction pipe 53 whereas the liquid refrigerant may be accumulated in a lower portion (lower half) of the refrigerant accommodating space 51*a*, vaporized, and suctioned into the compression chamber V through the refrigerant suction pipe 53.

On the other hand, the refrigerant suctioned into the compression chamber V may be gradually compressed by the orbiting motion of the roller 134, discharged from the discharge space into the discharge muffler 136 through the discharge port 1313 provided at the main bearing 131, and then exhausted out of the internal space 110*a* of the housing 110. The refrigerant may move toward the condenser 20 through the refrigerant discharge pipe 113 and then may be suctioned back into the compression chamber V through the aforementioned processes. The series of processes may then be repeatedly performed.

At this time, the compressor 10 may generate vibration due to the operations of the motor unit 120 and the compression unit 130. The vibration generated in the compressor 10 may be transmitted to the accumulator 50 through the refrigerant suction pipe 53 and the fixing bracket 115. The vibration may then be delivered to the refrigeration cycle device through the refrigerant connection pipe 52 connected to the accumulator 50, thereby aggravating noise in an outdoor unit including the refrigeration cycle device.

In consideration of this, in the related art, a pipe holder for supporting the refrigerant suction pipe 53 is additionally disposed inside the accumulator 50. However, as the pipe holder is added, the number of components and assembly processes may increase, which may cause an increase in manufacturing cost for the accumulator 50.

Also, in the related art, the bracket for fixing the accumulator 50 to the housing 110 has a simple shape merely for welding, so that the response of the accumulator 50 is considerably deteriorated. Since the existing welded brackets are only configured for fixing the accumulator 50, the brackets may be very vulnerable to noise due to vibration of the accumulator 50.

Also, where the accumulator fixing device for a compressor uses a bolt method in the related are, the response of the accumulator 50 is significantly deteriorated due to durability of a coupling structure, and the fixing device is significantly vulnerable to noise due to vibration of the accumulator. In addition, the bracket for fixing the accumulator 50 to the housing 110 has a complex structure that is fixed by bolts, which results in an increasing number of required products and an increasing time in the assembly operation.

In the present disclosure, by the structure in which the second arm portion 73 is connected to an end portion of each of the first and second support portions 71*b*-1 and 71*b*-2, the first and second support portions 71*b*-1 and 71*b*-2 are respectively connected to the two second arm portions 73, and a cavity 71*a* is formed between the first and second support portion 71*b*-1 and 71*b*-2, noise and vibration transmitted from the second arm portion 73 may be reduced by the first and second support portions 71*b*-1 and 71*b*-2 and the cavity 71*a* therebetween.

In particular, noise and vibration transmitted from the compressor 10 are transmitted from the second arm portion 73 through the first and second support portions 71*b*-1 and 71*b*-2, and noise and vibration transmitted from the accumulator 50 is transmitted to the first arm portion 72 and canceled out from each other.

In addition, a portion of noise and vibration transmitted from the compressor 10 through the cavity 71*a* may be discharged to the outside.

In this manner, the fixing device 70 of the present disclosure may reduce the transmission of excitation force of the compressor while applying the shape of the welded bracket, and reduce vibration of the accumulator 50 or the occurrence of noise caused thereby.

Figure 11:
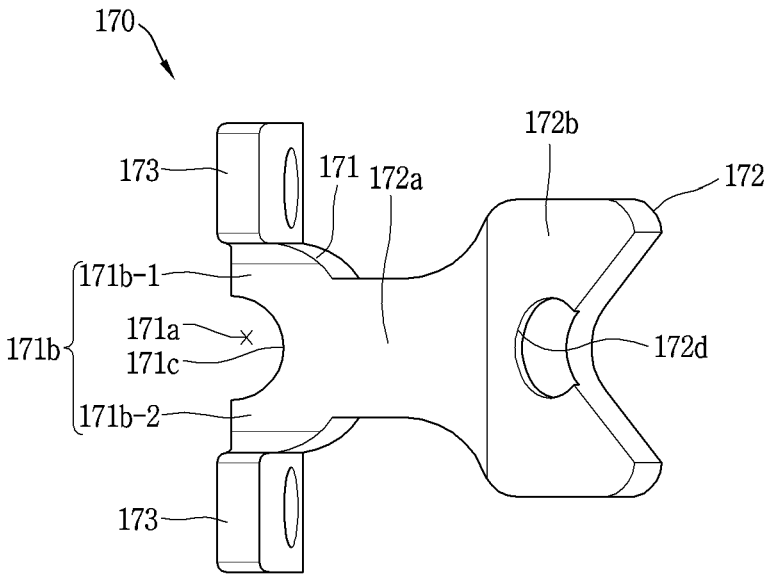
FIG. 11 is a side view of an example bracket.
Figure 12:
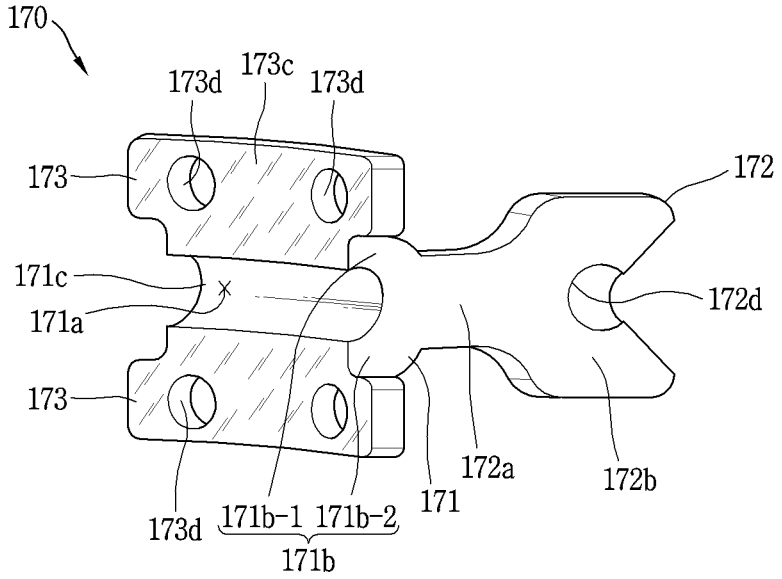
FIG. 12 is a perspective view of the bracket of FIG. 11.

FIG. 11 is a side view illustrating a fixing device 170 according to an implementation of the present disclosure, and FIG. 12 is a perspective view of the structure of FIG. 11.

Hereinafter, the accumulator fixing device 170 for a compressor of the present disclosure according to an implementation of the present disclosure will be described with reference to FIGS. 11 and 12.

The accumulator fixing device 170 for a compressor of the present disclosure includes a bracket body 171 and first and second arm portions 172 and 173.

In addition, the accumulator fixing device 170 may be a bracket.

The fixing device 170 according to this implementation is different from the fixing device 70 in that first and second support portions 171*b*-1 and 171*b*-2 and a side cross-section of a cavity 171*a* formed thereby include an arcuate structure.

The first arm portion 172 extends from the bracket body 171 and is coupled to the accumulator 50.

In FIGS. 11 and 12, one direction may be defined as a direction toward the right from the bracket body 171.

The second arm portion 173 extends from the bracket body 171 and is coupled to the housing 110 of the compressor.

In FIGS. 11 and 12, a direction crossing one direction may be defined as a direction toward the upper side and the lower side from the bracket body 171.

In addition, the bracket body 171 is provided with the cavity 171*a*. The cavity 171*a* is formed to be concave in one surface of the bracket body 171 facing the compressor.

Referring to FIGS. 11 and 12, the cavity 171*a* may be formed on one surface of the bracket body 171. One surface of the bracket body 171 on which the cavity 171*a* is formed may be a surface facing the housing 110 of the compressor, and may be a surface on the side where the coupling surface 173*c* of the second arm portion 173 is provided.

The cavity 171*a* is provided on one surface of the bracket body 171 to be concave in a direction in which the first arm portion 172 extends with respect to the coupling surface 173*c* of the second arm portion 173.

In addition, as shown in FIGS. 11 and 12, the cavity 171*a* may be provided to penetrate through both ends of the bracket body 171.

Referring to FIGS. 11 and 12, the cavity 171*a* may have an arch-shaped side cross-section.

In addition, as shown in FIGS. 11 and 12, the cavity 171*a* is formed across both left and right ends of the bracket body 171.

The first arm portion 172 may be formed as two pieces. In this case, the two first arm portions 172 may be provided on both sides of the bracket body 171, respectively.

Each of the two first arm portions 172 has a coupling surface 172*c* coupled and fixed to the outer periphery of the accumulator 50. In more detail, the coupling surface 172*c* of each of the two first arm portions 172 is coupled to the outer periphery of the casing 51 of the accumulator 50.

Meanwhile, the coupling surface 172*c* of the first arm portion 172 is provided on the second member 172*b*, and a hole or concave recess 172*d* for welding is formed on a rear surface of the coupling surface 172*c* of the second member 172*b*.

A welding rod is disposed in the hole or concave recess 172*d*, and welding is performed so that the coupling surface 172*c* of the second member 172*b* and the accumulator 50 are welded.

FIGS. 11 and 12 show that the concave recess 172*d* is formed on the rear surface of the coupling surface 172*c* of the second member 172*b*, but a hole may be formed to pass through the coupling surface 172*c*.

Meanwhile, a hole 173*d* or a concave recess for welding may be formed on the rear surface of the coupling surface 173*c* of the second arm portion 173.

A welding rod is disposed in the hole 173*d* or the concave recess, and welding is performed so that the coupling surface 173*c* of the second arm portion 173 and the housing 110 of the compressor 10 are welded.

FIGS. 11 and 12 show that the hole 173*d* is formed through the rear surface of the coupling surface 173*c* of the second arm portion 173. However, similarly to the concave recess 172*d* of the first arm portion 172, the concave recess may be formed on the rear surface of the coupling surface 173*c* of the second arm portion 173.

The first arm portion 172 may extend from a surface in which the cavity 171*a* is not formed to the opposite side of the cavity 171*a* in the bracket body 171.

The bracket body 171 may include a support portion 171*b*. The support portion 171*b* forms the cavity 171*a* and supports the two first arm portions 172 that are connected to each other on the opposite side of the one surface.

The support portion 171*b* may include first and second support portions 171*b*-1 and 171*b*-2.

The first and second support portions 171*b*-1 and 171*b*-2 may be formed to extend in two directions with the cavity 171*a* interposed therebetween.

In the present disclosure, the support portion 171*b* forming the cavity 171*a* forms a structure connecting the first arm portion 172 and the second arm portion 173 so that mutual responses of the first arm portion 172 and the second arm portion 173 may be canceled out to reduce noise and vibration.

In FIGS. 11 and 12, the support portion 171*b* is shown, and the first support portion 171*b* is formed at an upper part and the second support portion 171*b* is formed at a lower part. However, the present disclosure is not necessarily limited to this order, and the first support portion 171*b* may be formed at the lower part and the second support portion 171*b* may be formed at the upper part.

A second arm portion 173 is connected to an end portion of each of the first and second support portions 171*b*-1 and 171*b*-2.

First and second support portions 171*b*-1 and 171*b*-2 are connected to the two second arm portions 173, respectively, and the cavity 171*a* is formed between the first and second support portions 171*b*-1 and 171*b*-2. By this structure, noise and vibration transmitted from the second arm portion 173 are reduced by the first and second support portions 171*b*-1 and 171*b*-2 and the cavity 171*a* therebetween.

Referring to FIGS. 7, 11, and 12, it is understood that noise and vibration transmitted from the compressor 10 are transmitted from the second arm portion 173 through the first and second support portions 171*b*-1 and 171*b*-2, and noise and vibration transmitted from the accumulator 50 is transmitted to the first arm portion 172 and canceled out from each other.

In addition, a portion of the noise and vibration transmitted from the compressor 10 through the cavity 171*a* may be discharged to the outside.

Meanwhile, the bracket body 171 may have a cavity inner surface 171*c*. The cavity inner surface 171*c* may be provided between the first and second support portions 171*b*-1 and 171*b*-2.

That is, the cavity 171*a* is formed by the first and second support portions 171*b*-1 and 171*b*-2 and the cavity inner surface 171*c*.

As shown in FIGS. 11 and 12, the cavity inner surface 171*c* may be formed in a semicircular or arcuate curved surface.

Like the first arm portion 172, the second arm portion 173 may be provided as two pieces. The second arm portions 173 may be disposed with a cavity 171*a* interposed therebetween, and may be connected to the other end of the support portion 171*b*.

Meanwhile, the first arm portion 172 may include first and second members 172*a* and 172*b*.

The first member 172*a* protrudes from the bracket body 171 in one direction.

The second member 172*b* is bent by a predetermined angle from the first member 172*a*.

Two first arm portions 172 extend in the right direction from both side ends of the support portion 171*b* of the bracket body 171, and a first member 172*a* and a second member 172*b* that are sequentially connected to the support portion 171*b* of the bracket body 171 are illustrated.

Although not explicitly shown in FIGS. 11 and 12, like the fixing device 70 described above with reference to FIG. 9, in the fixing device 170, the second member 172*b* may be bent outwardly by a predetermined angle with respect to the first member 172*a*.

As the second member 172*b* is bent outwardly with respect to the first member 172*a*, a contact angle between the contact surfaces in which each of the two second members 172*b* is in contact with the accumulator 50 may be wider.

Accordingly, the accumulator 50 may be more stably coupled to the fixing device 170, thereby providing an advantageous structure capable of reducing noise and vibration.

As described above, the fixing device 170 is different from the fixing device 70 in that first and second support portions 171*b*-1 and 171*b*-2 and a side cross-section of a cavity 171*a* formed thereby include an arcuate structure.

Accordingly, in the present disclosure, since the fixing device 170 may be more firmly supported by the first and second support portions 171*b*-1 and 171*b*-2, a more stable coupling structure is provided.

Figure 13:
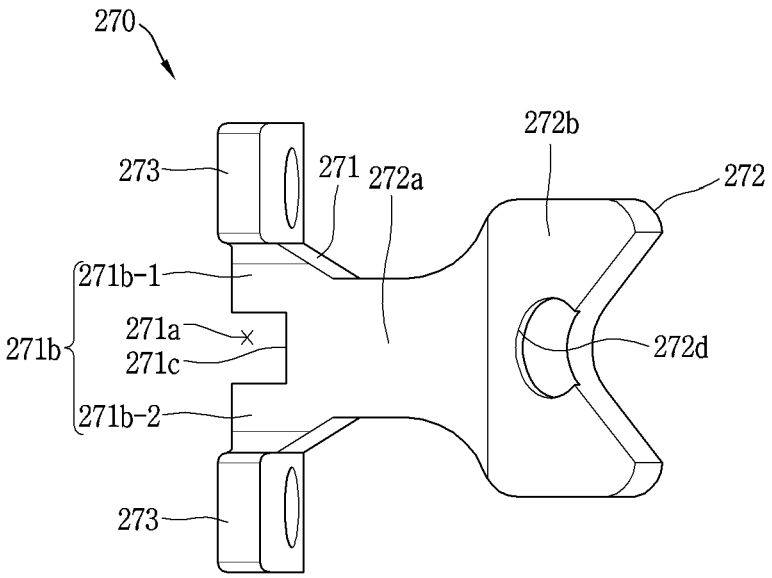
FIG. 13 is a side view an example bracket.
Figure 14:
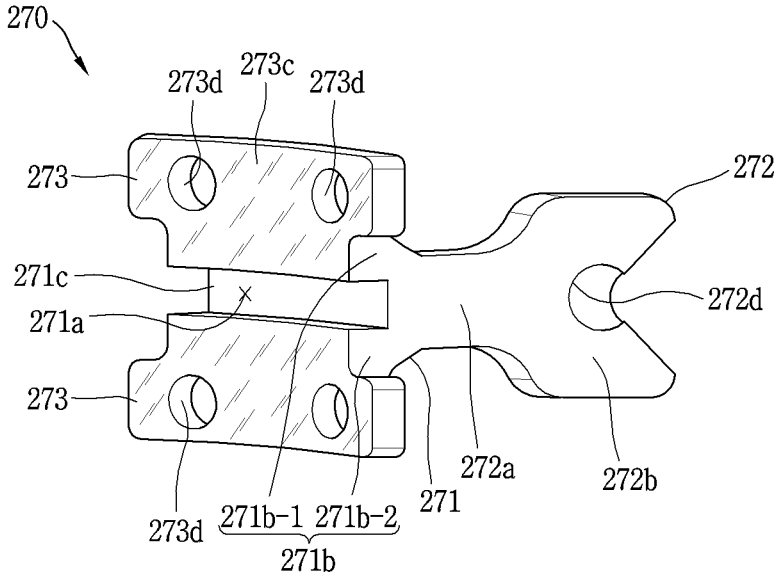
FIG. 14 is a perspective view of the bracket of FIG. 13.

FIG. 13 is a side view illustrating a fixing device 270 according to an implementation of the present disclosure, and FIG. 14 is a perspective view of the structure of FIG. 13.

Hereinafter, the accumulator fixing device 270 for a compressor according to an implementation of the present disclosure will be described with reference to FIGS. 13 and 14.

The accumulator fixing device 270 for a compressor of the present disclosure includes a bracket body 271 and first and second arm portions 272 and 273.

In addition, the accumulator fixing device 270 may be a bracket.

The fixing device 270 is different from the fixing device 70 in that first and second support portions 271*b*-1 and 271*b*-2 and a side cross-section of a cavity 271*a* formed thereby include an arcuate structure.

The first arm portion 272 extends from the bracket body 271 and is coupled to the accumulator 50.

In FIGS. 11 and 12, one direction may be defined as a direction toward the right from the bracket body 271.

The second arm portion 273 extends from the bracket body 271 and is coupled to the housing 110 of the compressor.

In FIGS. 13 and 14, a direction crossing one direction may be defined as a direction toward the upper side and the lower side from the bracket body 271.

In addition, the bracket body 271 is provided with the cavity 271*a*. The cavity 271*a* is formed to be concave in one surface of the bracket body 271 facing the compressor.

Referring to FIGS. 13 and 14, the cavity 271*a* may be formed on one surface of the bracket body 271. One surface of the bracket body 271 on which the cavity 271*a* is formed may be a surface facing the housing 110 of the compressor, and may be a surface on the side where the coupling surface 273*c* of the second arm portion 273 is provided.

The cavity 271*a* is provided on one surface of the bracket body 271 to be concave in a direction in which the first arm portion 272 extends with respect to the coupling surface 273*c* of the second arm portion 273.

In addition, as shown in FIGS. 13 and 14, the cavity 271*a* may be provided to penetrate through both ends of the bracket body 271.

Referring to FIGS. 13 and 14, the cavity 271*a* may have an arch-shaped side cross-section.

In addition, as shown in FIGS. 13 and 14, the cavity 271*a* is formed across both left and right ends of the bracket body 271.

The first arm portion 272 may be formed as two pieces. In this case, the two first arm portions 272 may be provided on both sides of the bracket body 271, respectively.

Each of the two first arm portions 272 has a coupling surface 272*c* coupled and fixed to the outer periphery of the accumulator 50. In more detail, the coupling surface 272*c* of each of the two first arm portions 272 is coupled to the outer periphery of the casing 51 of the accumulator 50.

Meanwhile, the coupling surface 272*c* of the first arm portion 272 is provided on the second member 272*b*, and a hole or concave recess 272*d* for welding is formed on a rear surface of the coupling surface 272*c* of the second member 272*b*.

A welding rod is disposed in the hole or concave recess 272*d*, and welding is performed so that the coupling surface 272*c* of the second member 272*b* and the accumulator 50 are welded.

FIGS. 13 and 14 show that the concave recess 272*d* is formed on the rear surface of the coupling surface 272*c* of the second member 272*b*, but a hole may be formed to pass through the coupling surface 272*c*.

Meanwhile, a hole 273*d* or a concave recess for welding may be formed on the rear surface of the coupling surface 273*c* of the second arm portion 273.

A welding rod is disposed in the hole 273*d* or the concave recess, and welding is performed so that the coupling surface 273*c* of the second arm portion 273 and the housing 110 of the compressor 10 are welded.

FIGS. 13 and 14 show that the hole 273*d* is formed through the rear surface of the coupling surface 273*c* of the second arm portion 273. However, similarly to the concave recess 272*d* of the first arm portion 272, the concave recess may be formed on the rear surface of the coupling surface 273*c* of the second arm portion 273.

The first arm portion 272 may extend from a surface in which the cavity 271*a* is not formed to the opposite side of the cavity 271*a* in the bracket body 271.

The bracket body 271 may include a support portion 271*b*. The support portion 271*b* forms the cavity 271*a* and supports the two first arm portions 272 that are connected to each other on the opposite side of the one surface.

The support portion 271*b* may include first and second support portions 271*b*-1 and 271*b*-2.

The first and second support portions 271*b*-1 and 271*b*-2 may be formed to extend in two directions with the cavity 271*a* interposed therebetween.

In the present disclosure, the support portion 271*b* forming the cavity 271*a* forms a structure connecting the first arm portion 272 and the second arm portion 273 so that mutual responses of the first arm portion 272 and the second arm portion 273 may be canceled out to reduce noise and vibration.

In FIGS. 13 and 14, the support portion 271*b* is shown, and the first support portion 271*b* is formed at an upper part and the second support portion 271*b* is formed at a lower part is shown. However, the present disclosure is not necessarily limited to this order, and the first support portion 271*b* may be formed at the lower part and the second support portion 271*b* may be formed at the upper part.

A second arm portion 273 is connected to an end portion of each of the first and second support portions 271*b*-1 and 271*b*-2.

First and second support portions 271*b*-1 and 271*b*-2 are connected to the two second arm portions 273, respectively, and the cavity 271*a* is formed between the first and second support portions 271*b*-1 and 271*b*-2. By this structure, noise and vibration transmitted from the second arm portion 273 are reduced by the first and second support portions 271*b*-1 and 271*b*-2 and the cavity 271*a* therebetween.

Referring to FIGS. 7, 13, and 14, it is understood that noise and vibration transmitted from the compressor 10 are transmitted from the second arm portion 273 to the first and second support portions 271*b*-1 and 271*b*-2, and noise and vibration transmitted from the accumulator 50 are transmitted to the first arm portion 272 and canceled out from each other.

In addition, a portion of the noise and vibration transmitted from the compressor 10 through the cavity 271*a* may be discharged to the outside.

Meanwhile, the bracket body 271 may have a cavity inner surface 271*c*. The cavity inner surface 271*c* may be provided between the first and second support portions 271*b*-1 and 271*b*-2.

That is, the cavity 271*a* is formed by the first and second support portions 271*b*-1 and 271*b*-2 and the cavity inner surface 271*c*.

As shown in FIGS. 13 and 14, the cavity inner surface 271*c* forms three sides of a rectangle together with the first and second support portions 271*b*-1 and 271*b*-2.

Like the first arm portion 272, the second arm portion 273 may be provided as two pieces. The second arm portions 273 may be disposed with a cavity 271*a* interposed therebetween, and may be connected to the other end of the support portion 271*b*.

Meanwhile, the first arm portion 272 may include first and second members 272*a* and 272*b*.

The first member 272*a* protrudes from the bracket body 271 in one direction.

The second member 272*b* is bent by a predetermined angle from the first member 272*a*.

Two first arm portions 272 extend in the right direction from both side ends of the support portion 271*b* of the bracket body 271, and a first member 272*a* and a second member 272*b* that are sequentially connected to the support portion 271*b* of the bracket body 271 are illustrated.

Although not explicitly shown in FIGS. 13 and 14, like the fixing device 70 described above with reference to FIG. 9, in the fixing device 270, the second member 272*b* may be bent outwardly by a predetermined angle with respect to the first member 272*a*.

As the second member 272*b* is bent outwardly with respect to the first member 272*a*, a contact angle between the contact surfaces in which each of the two second members 272*b* contact the accumulator 50 may be wider.

Accordingly, the accumulator 50 may be more stably coupled to the fixing device 270, thereby providing an advantageous structure capable of reducing noise and vibration.

As described above, the fixing device 270 is different from the fixing devices 70 and 170 in that first and second support portions 271*b*-1 and 271*b*-2 and a side cross-section of a cavity 271*a* formed thereby include a rectangular structure.

Meanwhile, the compressor 10 of the present disclosure includes the housing 110 forming an exterior and having a sealed internal space, the electric unit 120 provided in the internal space, the compression unit provided in the internal space and driven by the electric unit 120 to compress a refrigerant and discharge the compressed refrigerant to the internal space of the housing 110, and the accumulator 150 that is disposed outside the housing 110, supported by the housing 110, connected to the compression unit through the housing 110, and configured to separate a liquid refrigerant from the refrigerant suctioned into the compressor. The compressor 10 further includes the accumulator fixing devices 70, 170, and 270 coupled between the housing 110 and the accumulator 50 to couple the accumulator 50 to the housing 110. These components have been described above.

The present disclosure includes the first arm portion coupled to the accumulator and the second arm portion coupled to the housing of the compressor, and noise characteristic transmitted from the housing is improved by the bracket having the cavity in the bracket body.

In addition, the present disclosure may reduce the transmission of the excitation force from the housing of the compressor while applying the shape of the existing welded bracket, and reduce vibration of the accumulator or the occurrence of noise due to the vibration.

In addition, in the present disclosure, the support portion forming the cavity forms a structure connecting the first arm portion to the second arm portion, thereby canceling out the mutual response between the first arm portion and the second arm portion and thus reducing noise and vibration.

The present disclosure may improve the noise characteristics while applying the welded bracket.

In addition, while applying the shape of the existing welded bracket, the transmission of excitation force of the compressor may be reduced, and vibration of the accumulator or the occurrence of noise due to the vibration may be reduced.

In addition, in the present disclosure, as the second member is bent outwardly with respect to the first member, a contact angle at which a contact surface of the second member contacts the accumulator may be wider.

Accordingly, the accumulator may be more stably coupled to the bracket, thereby providing an advantageous structure capable of reducing noise and vibration.

In addition, in the present disclosure, the first and second support portions and a side cross-section of the cavity formed thereby form an arcuate structure, so that the fixing device may be more firmly supported by the first and second support portions, thereby providing a stable coupling structure.

The accumulator fixing devices 70, 170, and 270 for a compressor and the compressor 10 having the same are not limited to the configuration and method of the implementations described above, but the whole or some of the implementations may be selectively combined so that various modifications may be made.

It will be apparent to those skilled in the art that the present disclosure may be embodied in other specific forms without departing from the spirit or essential characteristics thereof. Therefore, it should also be understood that the above-described implementations are not limited by any of the details of the foregoing description, unless otherwise specified, but rather should be construed broadly within its scope as defined in the appended claims, Therefore, all changes and modifications that fall within the metes and bounds of the claims, or equivalents of such metes and bounds are therefore intended to be embraced by the appended claims.

What is claimed is:

1. A device for fixing an accumulator for a compressor, the device comprising:

a bracket body;

a first arm extending from the bracket body and coupled to the accumulator; and a second arm extending from the bracket body and coupled to a housing of the compressor, wherein the bracket body has a lower surface facing the compressor and defines a cavity at the lower surface, the cavity being configured to reduce vibration generated and transmitted from the compressor, wherein the first arm includes two first arm portions positioned at opposite sides of the bracket body respectively, wherein the bracket body includes a support portion supporting the two first arm portions, the two first arm portions being connected to a side of the support portion that is opposite to the lower surface of the bracket body, wherein the support portion includes a first support portion and a second support portion that extend in opposite directions from the bracket body, and wherein the cavity of the bracket body is positioned between the first support portion and the second support portion.

2. The device of claim 1, wherein the cavity of the bracket body extends between opposite ends of the bracket body.

3. The device of claim 1, wherein the second arm includes two second arm portions being connected to each other through the support portion, and wherein the cavity of the bracket body is positioned between the two second arm portions.

4. The device of claim 1, wherein the bracket body is positioned between the first support portion and the second support portion, and wherein the bracket body has a cavity inner surface that defines the cavity.

5. The device of claim 4, wherein a first inner surface of the first support portion and a second inner surface of the second support portion define the cavity, wherein the first inner surface and the cavity inner surface define an obtuse angle with each other, and wherein the second inner surface and the cavity inner surface define an obtuse angle with each other.

6. The device of claim 5, wherein the first inner surface and the cavity inner surface define a right angle to each other, and wherein the second inner surface and the cavity inner surface define a right angle to each other.

7. The device of claim 5, wherein the first inner surface and the second inner surface are connected to each other and define a curved surface to thereby define the cavity of the bracket body in an arch structure.

8. The device of claim 1, wherein a horizontal width of the second arm is wider than a horizontal width of each of the first support portion and the second support portion.

9. The device of claim 1, wherein the first arm extends from the bracket body in a first direction, and wherein the second arm extends from the bracket body in a second direction crossing the first direction.

10. The device of claim 9, wherein the second arm includes two second arm portions that extend in upward and downward directions respectively, the cavity being positioned between the two second arm portions, wherein a height of the device is defined by free ends of the two second arm portions, and wherein a vertical width of the cavity is 20% or more and 50% or less of the height of the device.

11. The device of claim 9, wherein the second arm includes two second arm portions that extend in upward and downward directions respectively, the cavity being positioned between the two second arm portions, wherein a height of the device is defined by free ends of the two second arm portions, and wherein a height of the first arm is smaller than the height of the device.

12. The device of claim 9, wherein the second arm has a coupling surface coupled to the housing of the compressor, and wherein a first depth of the device is defined from the coupling surface of the second arm to an end portion of the first arm in a direction, wherein a second depth of the cavity is defined in the direction, and wherein a ratio of the first depth to the second depth is 5 to 8:1.

13. The device of claim 1, wherein the first arm includes a coupling surface, the coupling surface having a curved surface that corresponds to a shape of the accumulator and is configured to couple to the accumulator.

14. The device of claim 13, wherein the coupling surface of the first arm defines a hole or a concave recess for welding.

15. The device of claim 1, wherein the second arm has a coupling surface, the coupling surface having a curved surface that corresponds to a shape of the housing of the compressor and is configured to couple to the compressor.

16. The device of claim 15, wherein the coupling surface of the second arm defines a hole or a concave recess for welding.

17. The device of claim 1, wherein the first arm is welded to the accumulator, and the second arm is welded to the compressor.

18. A device for fixing an accumulator for a compressor, the device comprising:

a bracket body;

a first arm extending from the bracket body and coupled to the accumulator; and a second arm extending from the bracket body and coupled to a housing of the compressor, wherein the bracket body has a surface facing the compressor and defines a cavity at the surface, the cavity being configured to reduce vibration generated and transmitted from the compressor, wherein the first arm includes:

a first member protruding from the bracket body; and a second member extending from the first member at a predetermined angle relative to the first member, and wherein the second member (i) extends outwardly relative to the first member and the bracket body and (ii) includes a coupling surface with a hole or a concave recess for welding the second member to the accumulator.

19. The device of claim 18, wherein the second member extends from an end portion of the first member and is curved outwardly with respect to the first member.

20. The device of claim 18, wherein the second member has a wider width in a vertical direction than the first member.

21. A compressor comprising:

a housing defining an internal space being sealed;

an electric unit provided in the internal space;

a compression unit provided in the internal space and configured to be driven by the electric unit to compress refrigerant and discharge refrigerant to the internal space of the housing;

an accumulator disposed outside the housing, supported by the housing, and connected to the compression unit through the housing, the accumulator being configured to separate liquid refrigerant from the refrigerant suctioned into the compressor; and an accumulator fixing device coupled between the housing and the accumulator and coupling the accumulator to the housing, wherein the accumulator fixing device comprising:

a bracket body;

a first arm extending from the bracket body and coupled to the accumulator; and a second arm extending from the bracket body and coupled to a housing of the compressor, wherein the bracket body has a surface facing the compressor and defines a cavity at the surface, the cavity being configured to reduce vibration generated and transmitted from the compressor, wherein the first arm extends from the bracket body in a first direction, wherein the second arm extends from the bracket body in a second direction crossing the first direction, wherein the first arm includes:

a first member protruding from the bracket body; and a second member extending from the first member at a predetermined angle relative to the first member, and wherein the second member has a wider width in a vertical direction than the first member.

* * * * *